United States Patent [19]

Betzko

[11] Patent Number: 4,568,822

[45] Date of Patent: Feb. 4, 1986

[54] APPARATUS FOR DETERMINING SMR CODES

[75] Inventor: Joseph F. Betzko, West Long Branch, N.J.

[73] Assignee: The United States of America as represented by the Secretary of the Army, Washington, D.C.

[21] Appl. No.: 524,716

[22] Filed: Aug. 19, 1983

[51] Int. Cl.[4] ..... G06C 27/00

[52] U.S. Cl. ..... 235/78 R

[58] Field of Search ..... 235/78 R, 78 A, 78 F, 235/78 G, 78 N, 78 M, 78 RC, 88 R, 88 N, 88 M, 88 G, 88 RC, 88 F, 64.7

[56] References Cited

U.S. PATENT DOCUMENTS 3,277,591 10/1966 Rutkofsky ..... 235/88 X

*Primary Examiner*—Lawrence R. Franklin
*Assistant Examiner*—Brian W. Brown
*Attorney, Agent, or Firm*—Anthony T. Lane; Jeremiah G. Murray; Robert A. Maikis

[57] ABSTRACT

Apparatus for determining the levels or echelons of a multi-character code of a supply source, maintenance and recoverability (SMR) code for component items in a parts inventory for military equipment comprising a circular code wheel including a first circular member in the form of a disc having first and second faces respectively divided into indicia bearing sectors the outer perimeter of which identify a particular character position of the code. Each sector is further divided into sub-sectors containing specific descriptive information relating to that sector and a particular code character for the specific information provided, the sub-sectors being masked by respective second and third manually rotatable circular disc type members attached to the first member and having first and second windows therein for selectively displaying the information and code character of the particular sub-sector, whereby a user can generate and assign an appropriate SMR code to a particular item by manipulation of the movable members to sequentially develop the required code.

1 Claim, 7 Drawing Figures

FIG. 1
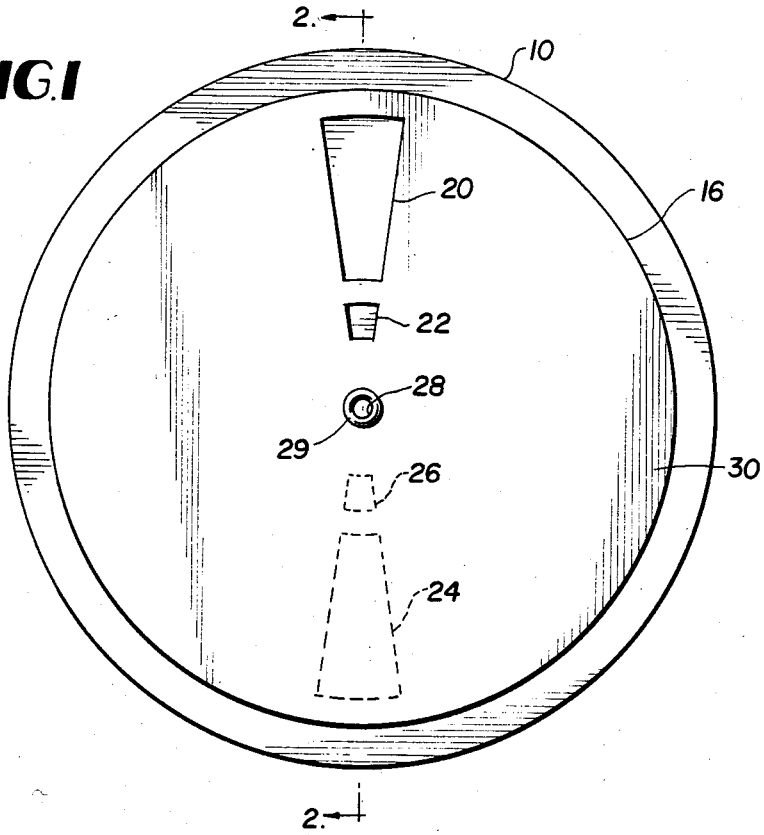
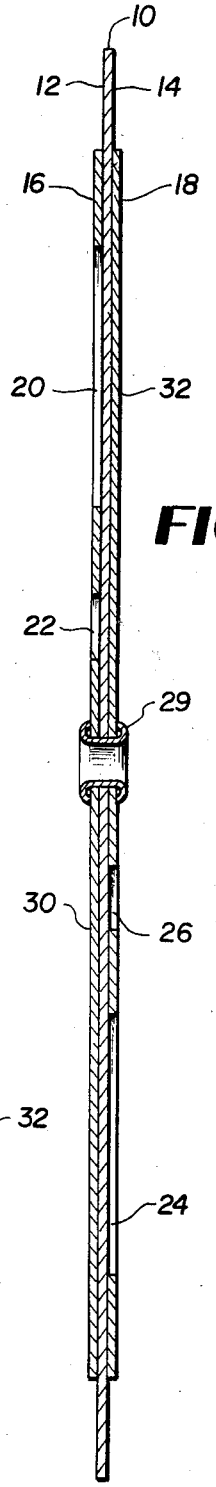
FIG. 2
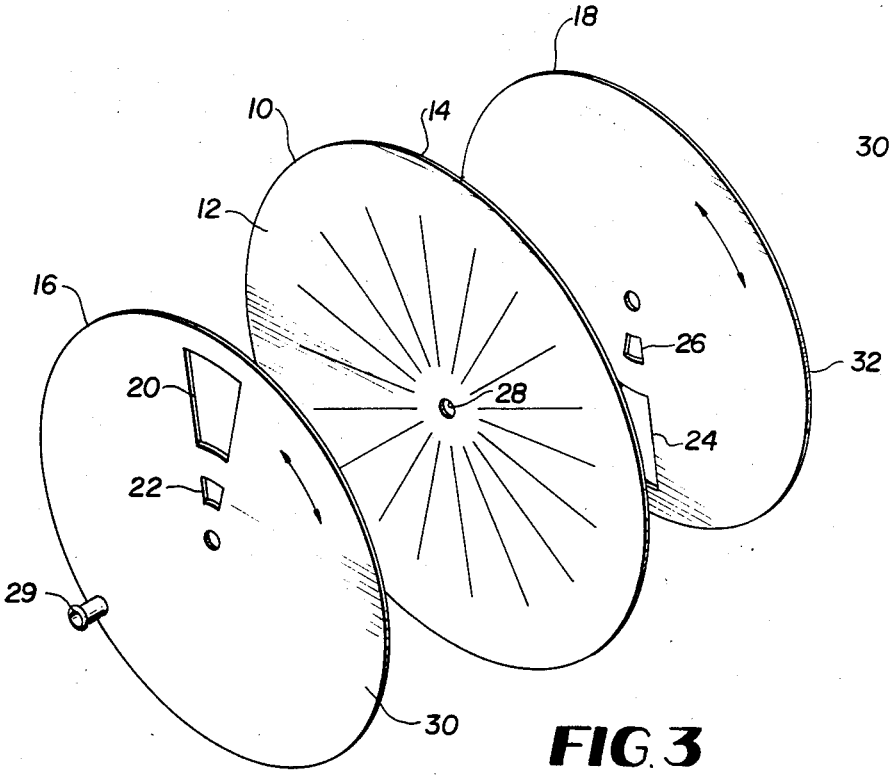
FIG. 3

APPARATUS FOR DETERMINING SMR CODES

The invention described herein may be manufactured, used and licensed by or for the Government for governmental purposes without the payment of any royalties thereon or therefor.

FIELD OF THE INVENTION

This invention relates generally to coding means and more particularly to apparatus for determining a multi-character code of a supply, maintenance and recoverability code for component items in a parts inventory.

BACKGROUND OF THE INVENTION

Heretofore, when a "provisioner" was required to develop and assign an appropriate and correlated supply, maintenance and recoverability (SMR) code relating spare parts for fielded end-item military equipment, the provisioner was required to refer to a prescribed Maintenance Allocation Chart (MAC) that delineates the overall maintenance and support concept for a specific piece of equipment. This chart comprises a table of codes to determine the levels or echelons of supply, maintenance and recoverability for component items or parts in the inventory, particularly for U.S. Army equipment. The SMR code, moreover, is a five character or "position" code and is formed by combining the first two positions of source of supply (S) with a third position that identifies the authorized replacement maintenance level (M), a fourth position that authorizes the repair level (M) and a fifth position which identifies the location or echelon level for recoverability (R) as applicable to a given component part in the inventory.

Accordingly, it is an object of the present invention to provide an improved means for generating a supply, maintenance and recoverability (SMR) code.

It is a further object of the present invention to enable provisioners to develop SMR codes more rapidly and more accurately.

It is still a further object of the invention to mechanize a maintenance allocation chart which removes the tedious and time consuming cross referencing, index and manipulation of information presently existing in a table look-up format.

SUMMARY

Briefly, the foregoing and other objects are achieved by means of a circular code wheel comprised of a circular member in the form of a disc having first and second faces, the inner regions of which are masked by movable circular second and third disc type members having respective first and second windows for displaying a particular code character or "position" of a supply, maintenance and recoverability (SMR) code for military equipment and wherein the first and second faces respectively are divided into sectors, the outer perimeter of which identifies a character or code "position" with each sector being further divided into sub-sectors containing specific descriptive information pertaining to the particular code character therefor and wherein the first and second windows are adapted to uncover the descriptive information and particular code position characters by manual rotation of the masking members, thereby allowing a "provisioner" to quickly develop and assign an appropriate SMR code for each of a plurality of components or parts in an equipment inventory.

BRIEF DESCRIPTION OF THE DRAWING

FIG. 1 is a top plan view of the preferred embodiment of the invention;

FIG. 2 is an enlarged central section of the embodiment shown in FIG. 1 taken along the lines 2—2 thereof;

FIG. 3 is an exploded perspective view of the preferred embodiment of the invention shown in FIG. 1;

DESCRIPTION OF THE PREFERRED EMBODIMENT

Figure 4:
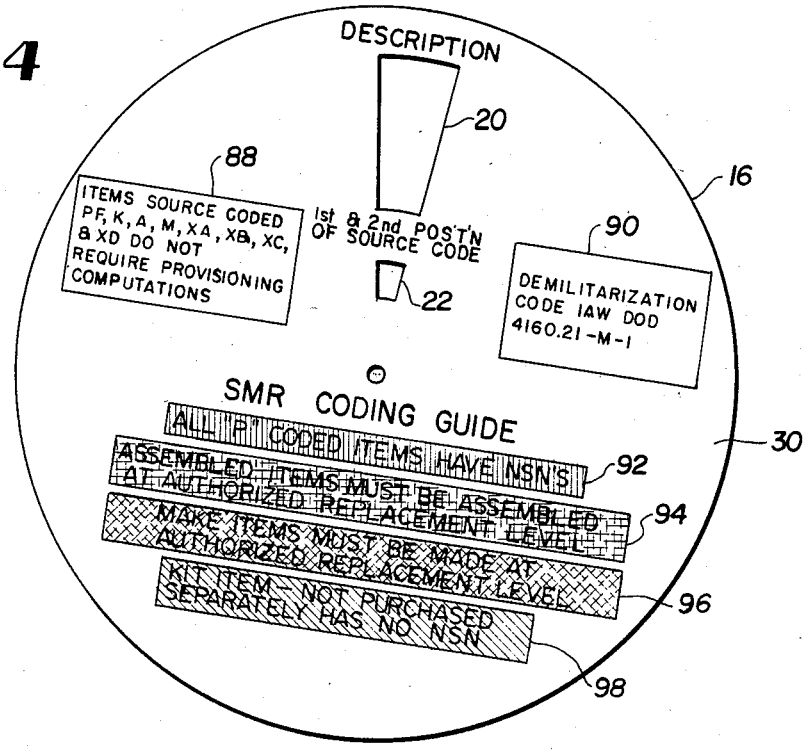
FIG. 4 is a plan view of the outer face of one of the smaller circular members shown in FIG. 3 and being illustrative of the indicia contained thereon.

Prior to describing the specific details of the invention as illustrated in the figures, consideration will first be given to a typical well known supply, maintenance and recoverability (SMR) coding reference chart which comprises a tabulation of interrelated information so that the construction of a code as to source (S), the authorized maintenance level (M) and the location or level for recoverability (R) as applicable to a given component or part for repairs or spares in a field end-item piece of Army equipment can be constructed. Such an SMR code typically comprises a combination of alpha numeric characters, preferably letters, in accordance with an established maintenance concept in support philosophy for a piece of equipment with which it is utilized. Such a chart is depicted in the following Tables I, II and III which set forth the first and second positions, third and fourth positions, and fifth position, respectively, of the SMR code.

Table I, for example, shown below, provides the necessary information to determine and assign two letters relating to the supply source of the component or spare part needed for a piece of equipment and wherein the letters in the left hand column, namely P, K, M, A and X constitutes the first "position" in the code, and whereas the letters in the inner right hand column constitute the second "position" of the code.

TABLE I

| | SOURCE (S) | |
|---|---|---|
| 1st Pos | 2nd Position | |
| Means of Acquiring the Support Item | | |
| P | A ITEM: | Stocked |
| | B ITEM: | Stocked, Insurance |
| | C ITEM: | Stocked, Shelf Life |
| | D ITEM: | Support, Initial Issue or Outfitting Stock only for additional initial issues or outfitting |
| | E EQUIPMENT: | Support, Stocked, Initial Issue or Outfitting, Specified Maintenance Activities |
| | F EQUIPMENT: | Support, Non-stock, Centrally Procured, on Demand |
| | G ITEM: | Stocked for Sustained Support. Uneconomical to reproduce at later time. |

TABLE I-continued

| SOURCE (S) | | | |
|---|---|---|---|
| 1st Pos | 2nd Position | | |
| K | D | ITEM: | Depot O/H Repair Kit. |
| | F | ITEM: | Maintenance Kit, place at O,F,H,L. |
| | B | ITEM: | In both Depot O/H & Maintenance Kits |
| M | O | ITEM: | Mfg or Fab at Organization |
| | F | ITEM: | Mfg or Fab at Direct Support |
| | H | ITEM: | Mfg or Fab at General Support |
| | L | ITEM: | Mfg or Fab at Spec Repair Activity |
| | D | ITEM: | Mfg or Fab at Depot |
| A | O | ITEM: | Assembled at Organization |
| | F | ITEM: | Assembled at Direct Support |
| | H | ITEM: | Assembled at General Support |
| | L | ITEM: | Assembled at Spec. Repair Activity |
| | D | ITEM: | Assembled at Depot |
| X | A | ITEM: | Requisition Next-Higher-Assembly |
| | B | ITEM: | Not procured or stocked. Obtain through salvage. Requisition. |
| | C | Installation drawing, diagram, instruction sheet, field service dwg. ident by mfg P/N | |
| | D | ITEM: | Support, non-stock. Requistion. Low mortality. Not obtainable from cannibalization. |

The letter P indicates a "stocked" item, the letter K a "kit" item, M stands for fabricating or manufacturing an item at a particular location, A is indicative of assembly location of an assembled item and X stands for "non-stocked" items. Further as shown in Table I, the second position code letters further define the particular source of supply of the items P, K . . . X.

The third and fourth "position" of the SMR code are set forth in Table II below and constitute two columns of letters with the third position code letter as indicated by the left hand column and which denotes the lowest level of authority authorized to remove and/or replace an item, whereas the right hand column is indicative of the lowest level of authority having the capability to perform a complete repair of the item.

TABLE II

| MAINTENANCE (M) | |
|---|---|
| 3rd Position | 4th Position |
| USE: Lowest level authorized to remove, replace (i.e., use) the item. | REPAIR: Lowest level with capability to perform complete repair. |
| C Crew | Z None |
| O Organization | B None Recondition by adjusting lubricating |
| F Direct Support | O Organization |
| H General Support | F Direct Support |
| L Specialized Repair Activity | H General Support |
| D Depot | L Specialized Repair Activity. |
| | D Depot |

With respect to Table III, as set forth below, it comprises a single column of letters indicative of the fifth "position" of the SMR code and designates the final disposition of a replaced item or part.

TABLE III

| RECOVERABILITY (R) | |
|---|---|
| 5th Position DISPOSITION: When unserviceable or uneconomically repairable, condemn and dispose. | |
| Z | Non-Repairable Any Auth Level |
| O | Repair at Organization |
| F | Repair at Direct Support |
| H | Repair at General Support |
| L | Repair at Specialized Repair Activity |
| D | Repair at Depot |
| A | Special Handling (Precious metal content, high dollar value). Refer to appl manual/dir for specific instructions. |

With the foregoing in mind, reference will now be made to the accompanying drawings wherein the preferred embodiment of the invention is depicted and comprises a circular manually operable code wheel which, in a simple and straightforward manner, is adapted to generate an appropriate SMR code heretofore generated by referring to an SMR coding reference chart set forth in the foregoing Tables I, II and III.

Figure 5:
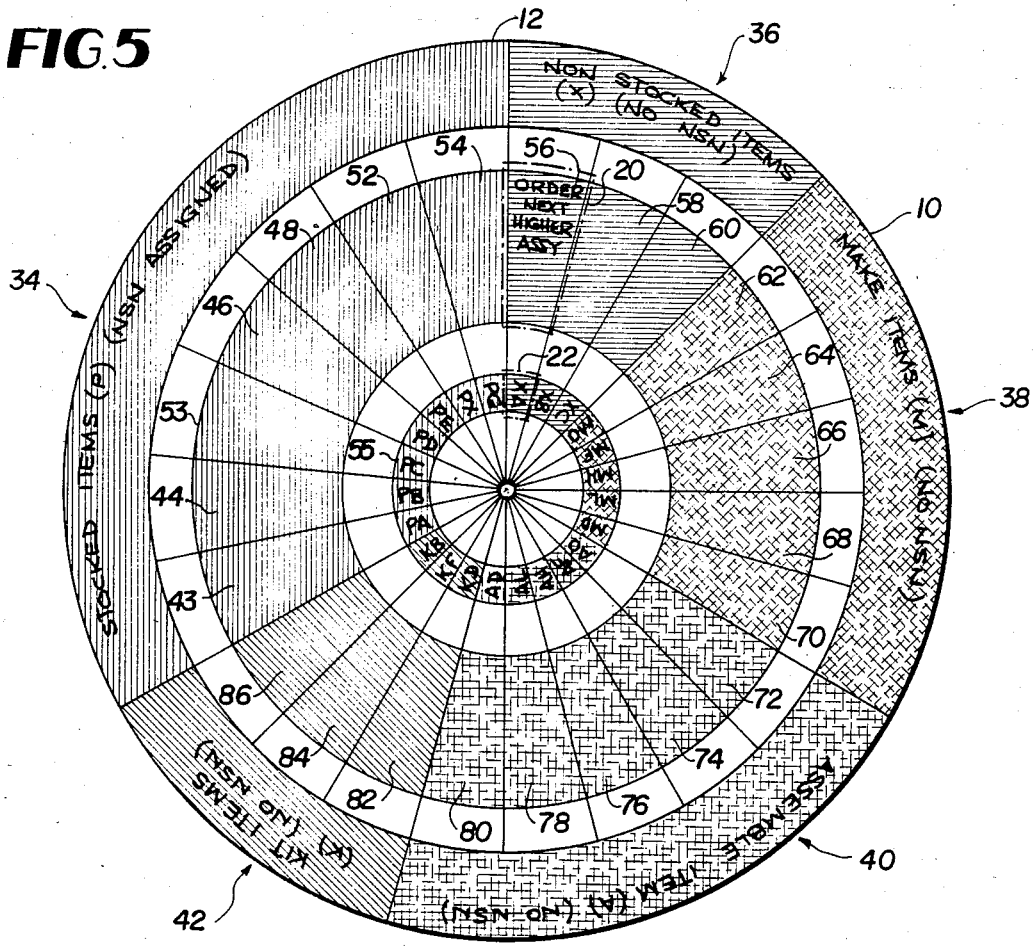
FIG. 5 is a plan view of the face of the larger circular member shown in FIG. 3 which is partially masked by the member of FIG. 4 and being illustrative of the indicia contained thereon.
Figure 6:
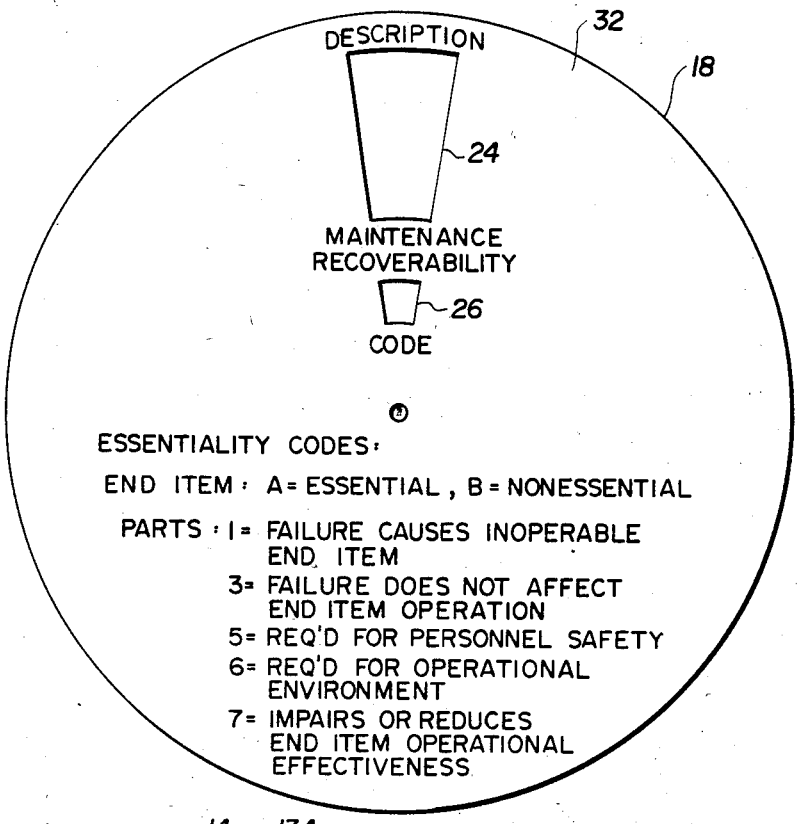
FIG. 6 is a plan view of the outer face of the other smaller circular member shown in FIG. 3 and being illustrative of the indicia contained thereon.
Figure 7:
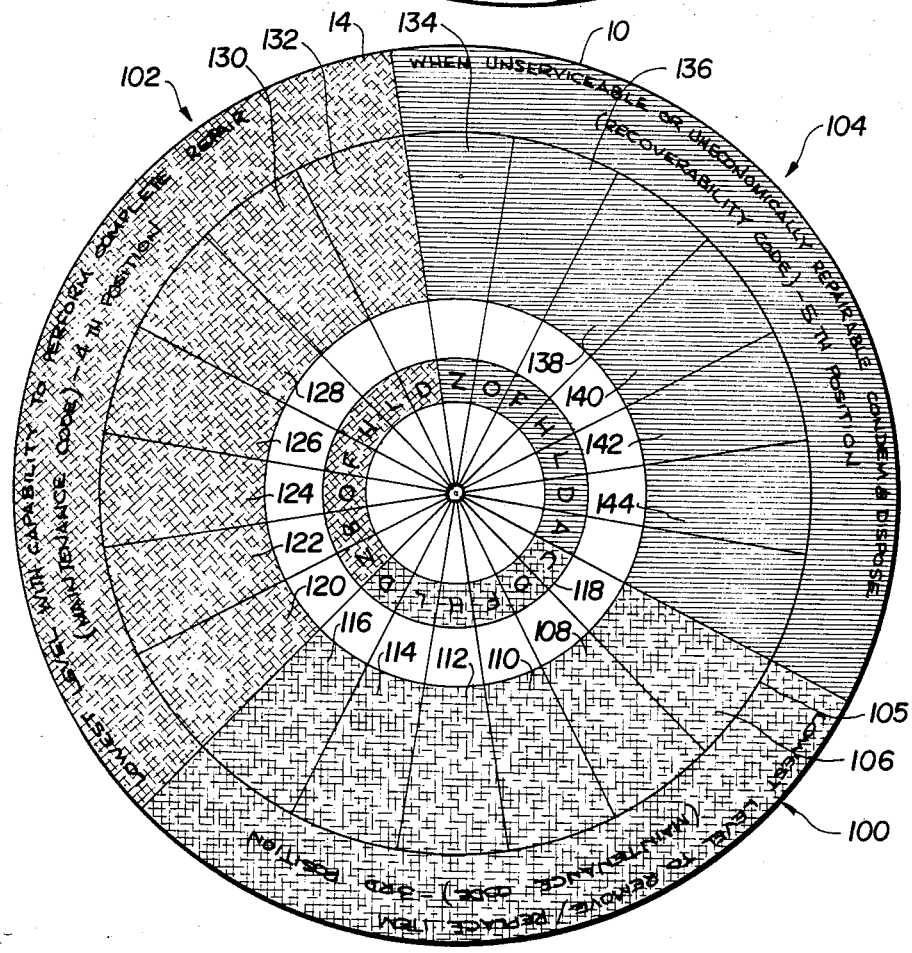
FIG. 7 is a plan view of the other face of the larger circular member shown in FIG. 3 which is partially masked by the member of FIG. 6 and being illustrative of the indicia contained thereon.

As shown in FIGS. 1, 2 and 3, reference numeral 10 designates a relatively large, thin, flat circular base member such as a disc having front and rear indicia bearing faces 12 and 14. The indicia appearing at the perimeter region of the faces 12 and 14 as shown in FIGS. 5 and 7 remain visible at all times; however, the indicia, not shown, located inwardly thereof is masked by respective smaller thin, flat, rotatable disc type members 16 and 18 except for the indicia displayed by the windows 20 and 22 in the member 16 and the windows 24 and 26 in member 18. Furthermore, the rotatable masking members 16 and 18 are secured to the center 28 of the larger base member 10 by a rivet 29, for example, so that either masking member 16 or 18 can be manually rotated independently of one another over the respective faces 12 and 14 of the base member 10. The outer faces 30 and 32 of the rotatable masking disc members 16 and 18, moreover, contain indicia shown in FIGS. 4 and 6, respectively, further related to the indicia contained on the respective faces 12 and 14 of the base member 10.

The indicia on the front face 12 of the base member 10 is adapted to provide the supply (S) portion (positions 1 and 2) of the SMR code referred to above. The code generating indicia relating thereto is arranged in five circular segments or sectors 34, 36, 38, 40 and 42 as shown in FIG. 5 which are color coded white, blue, orange, yellow and green, respectively. The sector 34 relates to "stocked items" having a first code position character P assigned thereto and comprise items having an NSN (National Stock Number) assigned thereto. The sector 34, moreover, is subdivided into six subsectors 43, 44, 46 48, 50, 52 and 54 which contains the descriptive material, not shown, in an intermediate annular region 53 for assigning the second code position character A through G which is shown along with the first position code character P in an inner annular segment 55. The descriptive material in region 53 and the first two positions of the source code in region 55 is shown below comprising:

| SECTOR - 34 STOCKED ITEMS (P)(NSN ASSIGNED) | | |
|---|---|---|
| SUB-SECTOR | DESCRIPTION | SOURCE CODE |
| 43 | STOCKED NORMAL | PA |
| 44 | STOCKED FOR INSURANCE - ESSENTIALLY DICTATES ON HAND REQUIREMENT | PB |
| 46 | SHELF LIFE OF LESS THAN 60 MONTHS | PC |
| 48 | INITIAL ISSUE | PD |
| 50 | SUPPORT EQUIPMENT | PE |
| 52 | PROCURE ON DEMAND/ READILY AVAILABLE | PF |
| 54 | STOCKED FOR SUSTAINED SUPPORT - NOT ECONOMICAL LATER | PG |

The second sector 36 which relates to "non-stocked items" has a first code position character X assigned thereto and comprises items having no NSN assigned thereto. It comprises three categories which are set forth in the sub-sectors 56, 58 and 60 and which is shown comprising the following description in the first two code positions.

| SECTOR - 36 NON-STOCKED ITEMS (X) (NO NSN) | | |
|---|---|---|
| SUB-SECTOR | DESCRIPTION | SOURCE CODE |
| 56 | ORDER NEXT HIGHER ASSEMBLY | XA |
| 58 | OBTAIN THRU SALVAGE OR ORDER BY P/N | XB |
| 60 | IDENTIFY USING INSTALLATION DRAWINGS | XC |

With respect to the third sector 38, it concerns the manufacture or fabrication of items i.e. "make items" which are assigned a first code position character M and having no NSN assigned thereto. Such items are further categorized in accordance with the descriptive material and second position code letters assigned thereto and which are contained in the sub-sectors 62, 64, 66, 68 and 70 which is further tabulated below as:

| SECTOR - 38 MAKE ITEMS (M) (NO NSN) | | |
|---|---|---|
| SUB-SECTOR | DESCRIPTION | SOURCE CODE |
| 62 | MAKE AT ORGANIZATION | MO |
| 64 | MAKE AT DIRECT SUPPORT | MF |
| 66 | MAKE AT GENERAL SUPPORT | MH |
| 68 | MAKE AT SPECIAL REPAIR ACTIVITY | ML |
| 70 | MAKE AT DEPOT | MD |

With respect to the sector 40, it relates to the location of assembly of various items i.e. "assemble items" and which is given a first code position character A but has no NSN assigned thereto. The sector 40 is further subdivided into five sub-sectors 72 through 80 which have second code position characters O, F, H. L and D as shown in region 55 assigned thereto along with the pertinent descriptive information relative thereto and which is set forth below as:

| SECTOR - 40 ASSEMBLE ITEM (A) (NO NSN) | | |
|---|---|---|
| SUB-SECTOR | DESCRIPTION | SOURCE CODE |
| 72 | ASSEMBLE AT ORGANIZATION | AO |
| 74 | ASSEMBLE AT DIRECT SUPPORT | AF |
| 76 | ASSEMBLE AT GENERAL SUPPORT | AH |
| 78 | ASSEMBLE AT SPECIAL REPAIR ACTIVITY | AL |
| 80 | ASSEMBLE AT DEPOT | AD |

The remaining sector 42 relates to repair and maintenance kits which have a first code position designation K. These "kit items" are further sub-divided into categories outlined in sub-sectors 82, 84 and 86 to provide the second code position letters D, F and B, respectively, and having the following descriptive material related thereto shown below as:

| SECTOR - 42 KIT ITEMS (K) (NO NSN) | | |
|---|---|---|
| SUB-SECTOR | DESCRIPTION | SOURCE CODE |
| 82 | P/O DEPOT O/H KIT | KD |
| 84 | P/O FIELD LEVEL KIT | KF |
| 86 | P/O FIELD AND DEPOT KIT | KB |

Thus, by manually turning the rotatable disc member 16 (FIG. 4) over the face 12 of member 10 (FIG. 5) to a desired sub-sector position and uncovering one sub-sector 43 through 86 of the five sectors 34 through 42, the window 20 of member 16 will provide the essential descriptive information, while the window 22 will reveal the first and second position characters of the source code (S) portion of the SMR code located at the inner annular region 55. It should also be pointed out that the outer face 30 of the rotatable member 16 as shown in FIG. 4 also contains descriptive material located within the blocks 88, 90, 92, 94, 96 and 98 which are further helpful in generating the source code portion of the SMR code.

Turning now to the rear face 14 of the circular base member 10 and as illustrated in FIG. 7, it contains indicia for determining the characters for third, fourth and fifth position code of the SMR code. As shown, the indicia is separated into three sectors 100, 102 and 104, respectively. The sectors 100 and 102 relate to the maintenance code (M) portion of the SMR code, while the sector 104 relates to the recoverability code (R) portion of the SMR code. Referring now to the sector 100, the third position code character is determined in accordance with the descriptive material and the code character contained in the intermediate annular region 105 of sub-sectors 106, 108, 110, 112, 114 and 116, with the appropriate code characters C, O, F, H, L and D being located at the inner annular region 118. Furthermore, the descriptive material and the pertinent code character letters for sector 100 are set forth below as:

| SECTOR - 100 LOWEST LEVEL AUTHORIZED TO REMOVE/REPLACE ITEM (3RD POSITION) | | |
|---|---|---|
| SUB-SECTOR | DESCRIPTION | MAIN-TENANCE CODE |
| 106 | CREW | C |
| 108 | ORGANIZATION | O |
| 110 | DIRECT SUPPORT | F |
| 112 | GENERAL SUPPORT | H |
| 114 | SPECIAL REPAIR ACTIVITY | L |
| 116 | DEPOT | D |

Regarding the sector 102, it is adapted to supply the fourth position of the SMR code and the sector is further subdivided into seven sub-sectors 120 through 132 which are adapted to supply the letters Z, B, O, F, H, L and D in accordance with the pertinent descriptive information relating thereto and set forth below as:

| SECTOR - 102 LOWEST LEVEL WITH CAPABILITY TO PERFORM COMPLETE REPAIR (4TH POSITION) | | |
|---|---|---|
| SUB-SECTOR | DESCRIPTION | MAIN-TENANCE CODE |
| 120 | NON-REPAIRABLE | Z |
| 122 | NONE RECONDITION BY ADJUSTING OR LUBRICATING | B |
| 124 | ORGANIZATION | O |
| 126 | DIRECT SUPPORT | F |
| 128 | GENERAL SUPPORT | H |
| 130 | SPECIAL REPAIR ACTIVITY | L |
| 132 | DEPOT | D |

The fifth position of the SMR code is provided by seven sub-sectors 134, 136, 138 . . . 144 of the face 14 to provide the recoverability code portion (R) which comprises one of the letters Z, O, F, H, L, D and A located in the region 118 per the information related thereto in the appropriate sub-sector and as set forth below:

| SECTOR - 104 WHEN UNSERVICEABLE OR UNECONOMICALLY REPAIRABLE CONDEMN AND DISPOSE (5TH POSITION) | | |
|---|---|---|
| SUB-SECTOR | DESCRIPTION | RECOVER-ABILITY CODE |
| 134 | NON-REPAIRABLE ANY AUTHORIZED LEVEL | Z |
| 136 | REPAIR AT ORGANIZATION | O |
| 138 | REPAIR AT DIRECT SUPPORT | F |
| 140 | REPAIR AT GENERAL SUPPORT | H |
| 142 | REPAIR AT SPECIAL ACTIVITY | L |
| 144 | REPAIR AT DEPOT | D |
| 146 | SPECIAL HANDLING PRECIOUS METAL CONTENT HIGH $ VALUE | A |

In operation, the masking disc member 18 is manually moved over the face 14 of the base member 10 in sequence from sector to sector of the sectors 100, 102 and 104 whereby the window 26 (FIG. 6) reveals the appropriate code letters contained in the annular region 118 as it pertains to the descriptive information revealed by the window 24. Additionally, the outer face 32 of the masking disc member 18 contains further information with respect to essentiality codes also connected with repairs and spare parts for military equipment.

Thus, in operation, the circular code wheel assembly is first viewed from the front, i.e. toward the face 12 of the base member 10 (FIG. 5) and when the larger outer window 20 of the rotatable disc member 16 (FIG. 4) is turned to the sub-sector that appropriately describes the source code information that relates to the component or part that is to be coded, then the smaller "inner window" 22 will display the proper first two positions of the source (S) portion of the SMR code being developed. Then by turning the assembly to the reverse side i.e. toward the face 14 of the base member 10 (FIG. 7) and once more positioning the rotatable disc member 18 (FIG. 6) in accordance with the information displayed by the larger outer window 24, the smaller inner window 26 will sequentially display the maintenance (M) and the recoverability (R) portions of the SMR code, resulting in the determination of the third, fourth and fifth position of the SMR code. Accordingly, utilization of the two sides of the code wheel in accordance with the subject invention will permit a user such as a "provisioner" to construct the SMR code for a given component or part quickly and appropriately within the range of valid code combinations while removing possible errors that exist in the heretofore table look-up procedure utilizing an SMR Coding Reference Chart.

The apparatus of the subject invention provides three additional bits of information: (1) the block 88 on the face 30 of the movable member 16 as shown in FIG. 4 informs the user which supply source codes (portions 1 and 2) of the SMR code require provisioning computations, i.e., determination of supply stockage levels; (2) block 90 on the face 30 as shown in FIG. 4 further informs the user of the source document (DOD 4160.21-M-1) required to determine a demilitarization code which becomes a "sixth" position of the total SMR code; (3) the face 32 of the movable circular member 18 as shown in FIG. 7, allows the user to determine the essentiality code for the component item in the parts inventory which is a separate code apart from the SMR code.

Having shown and described what is at present considered to be the preferred embodiment of the invention, it should be noted that the same has been made by way of illustration and not limitation. Accordingly, all modifications, alterations and changes coming within the spirit and scope of the invention as set forth in the appended claims are herein meant to be included.

I claim:

1. Apparatus for generating a composite supply, maintenance and recoverability (SMR) code having five code positions for replacement parts of military equipment in an inventory, said code having a code character in each of said code positions and a supply source (S) code portion consisting of the first two code positions, a maintenance (M) code portion consisting of the third and fourth code positions and a recoverability (R) code portion consisting of the fifth code position, said apparatus comprising:

a first relatively-thin flat circular member having first and second circular faces on opposite sides thereof, each of said faces being divided into a plurality of pie-shaped sectors extending radially outwardly from the center of the face, each of said sectors having a predetermined angular width and being divided into an inner sub-sector adjacent the center of the face and an outer sub-sector adjacent the periphery of the face, the inner and outer sub-sectors of each sector being spaced a radial distance apart, the said plurality of sectors of said first face containing descriptive material and two code characters for generating the supply source (S) portion of the code with said descriptive material being disposed within the outer sub-sectors of said first face sectors and said two code characters representing said first two code positions being disposed within the inner sub-sectors of said first face sectors, the said plurality of sectors of said second face being grouped into first, second and third groups of sectors containing descriptive material and single code characters for generating both the maintenance (M) and recoverability (R) portions of the code with the descriptive material for said maintenance (M) code portion being disposed within the outer sub-sectors of said first and second groups of sectors, the descriptive material for said recoverability (R) code portion being disposed within the outer sub-sectors of said third group of sectors, the single code characters representing said third code position disposed within the inner sub-sectors of said first group of sectors, the single code characters representing said fourth code position disposed within the inner sub-sectors of said second group of sectors and the single code characters representing said fifth code position disposed within the inner sub-sectors of said third group of sectors, the sectors on both said first and second faces being selectively color coded; and second and third relatively-thin flat circular members rotatably secured to said first member at the center thereof on said first member and second faces, respectively, said second member having first and second radially-aligned and spaced apart windows therein having an angular width which is substantially the same as said predetermined angular width of the sectors on said first member first face which expose to view the inner and outer sub-sectors, respectively, of the plurality of sectors on said first member first face so that when said second member is rotated with respect to said first member to an angular position exposing a selected sector of said member first face said second window will display said descriptive material of the supply source (S) portion of the code and said first window will display the two code characters representing said first and second code positions, said third member having first and second radially-aligned and spaced apart windows therein having an angular width which is substantially the same as said predetermined angular width of the sectors on said first member second face which expose to view the inner and outer sub-sectors, respectively, of said three groups of sectors on said first member second face so that when said third member is rotated with respect to said first member to an angular position exposing a selected sector of said first and second groups of sectors on said first member second face said third member second window will display said descriptive material of the maintenance (M) portion of the code and said third member first window will display the single code characters representing said third and fourth code positions respectively, and when said third member is rotated with respect to said first member to an angular position exposing a selected sector of said third group of sectors on said first member second face said third member second window will display said descriptive material of the recoverability (R) portion of the code and said third member first window will display the single code characters representing said fifth code position, whereby said composite code is generated by rotating said second and third members in a predetermined code position sequence and noting the particular code characters exposed.

* * * * *